United States Patent [19]

Kuhns et al.

[11] 4,071,195

[45] Jan. 31, 1978

[54] SPRAY AND FOAM PRODUCING NOZZLE APPARATUS

[75] Inventors: Garrett D. Kuhns, Eagan, Minn.; Norman E. Astorp, Sumner, Iowa; Richard V. Mullen, Cottage Grove, Minn.; John Ellwood Thomas, Riverfalls, Wis.

[73] Assignee: Economics Laboratory, Inc., St. Paul, Minn.

[21] Appl. No.: 693,650

[22] Filed: June 7, 1976

Related U.S. Application Data

[63] Continuation-in-part of Ser. No. 612,865, Sept. 12, 1975, Pat. No. 3,961,754.

[51] Int. Cl.[2] ..... B05B 15/00

[52] U.S. Cl. ..... 239/289; 239/311; 239/436; 239/521; 239/524; 239/599; 239/600

[58] Field of Search ..... 239/312, 436, 521, 524, 239/295, 599, 600, 310, 289, 311

[56] References Cited

U.S. PATENT DOCUMENTS

| | | | |
|---|---|---|---|
| Re. 204,488 | 8/1937 | Zinkil | 299/120 |
| 1,364,163 | 1/1921 | Wampler | 239/521 X |
| 2,879,003 | 3/1959 | Finn | 239/398 |
| 3,085,750 | 4/1963 | Kenshol | 239/295 X |
| 3,231,134 | 1/1966 | Webster | 239/310 X |

*Primary Examiner*—Richard A. Schacher

*Attorney, Agent, or Firm*—Charles E. Golla

[57] ABSTRACT

An improved nozzle apparatus rapidly convertible, while operating, between spray and foam forming modes of operation. An elongate rigid generally cylindrical first conduit member receives surfactant bearing solution at an inlet port thereof and directs the solution under pressure to a spray forming nozzle connected at an outlet port of the first conduit. A second elongate conduit member coaxially slidably overlies the first conduit member and is movable relative thereto between extended and retracted positions. When in its retracted position, the second conduit member exposes the spray-forming nozzle; which is then enabled to direct a spray pattern of the solution longitudinally outward from the apparatus. When in its extended position, the second conduit member encompasses the spray-forming nozzle, and aspirates the spray therefrom with air to form foam which is ejected longitudinally outward from the second conduit member. Foam dispersing means are provided at the outlet port of the second conduit member for spreading the ejected foam in a fan-shaped pattern. Fastener means connecting the first and second conduit members enables rapid positioning of the second conduit member between its retracted and extended positions. Handle means are provided for enabling an operator to hand-carry the nozzle apparatus and to directionally aim the spray and foam patterns ejected therefrom to a target area.

15 Claims, 18 Drawing Figures

FIG. 1
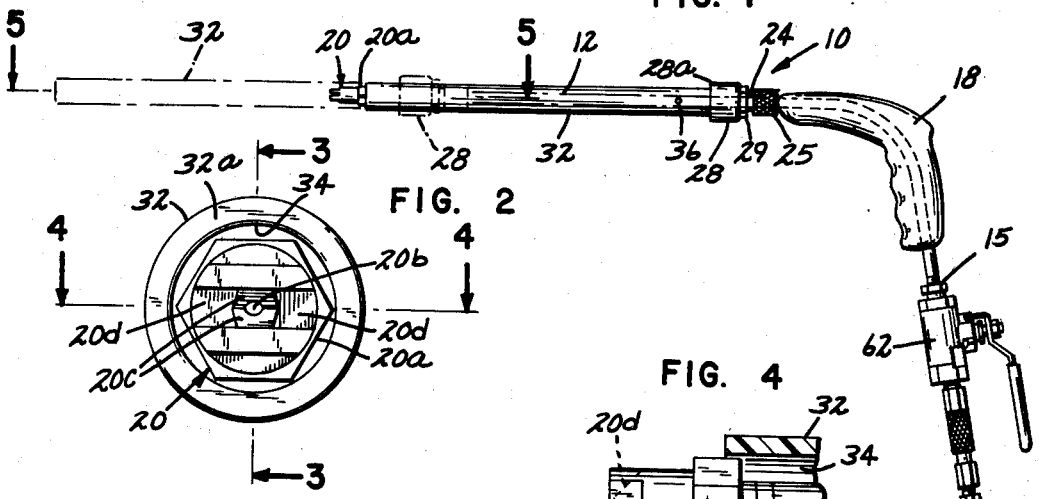
FIG. 2
FIG. 3
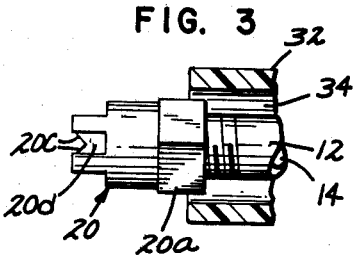
FIG. 4
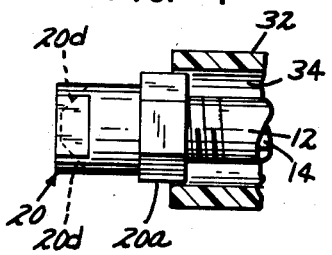
FIG. 5
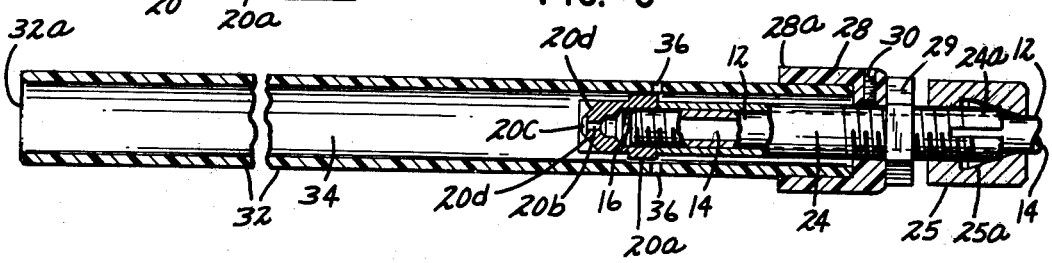
FIG. 6
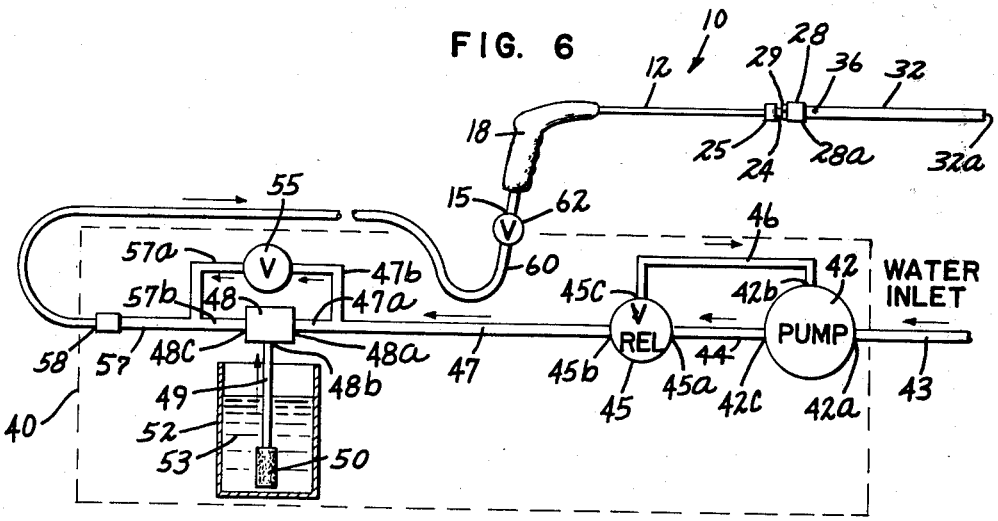

FIG. 7
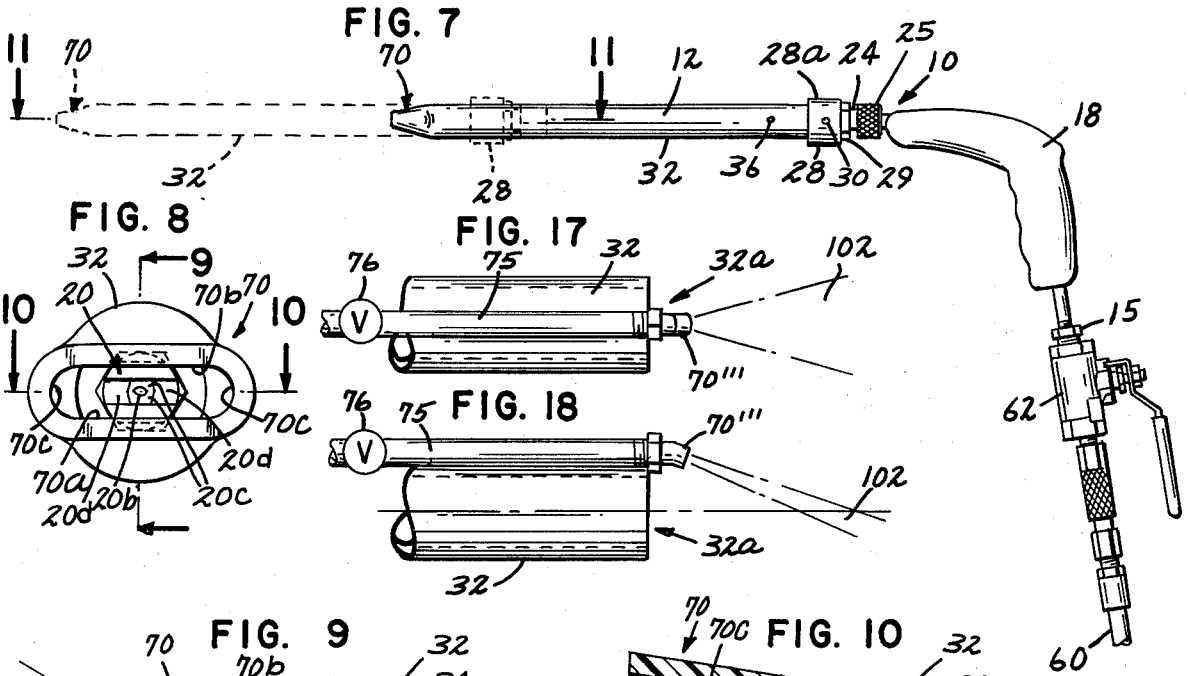
FIG. 8
FIG. 17
FIG. 18
FIG. 9
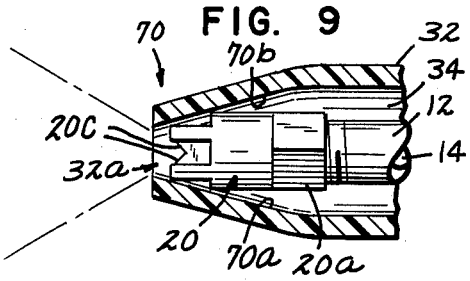
FIG. 10
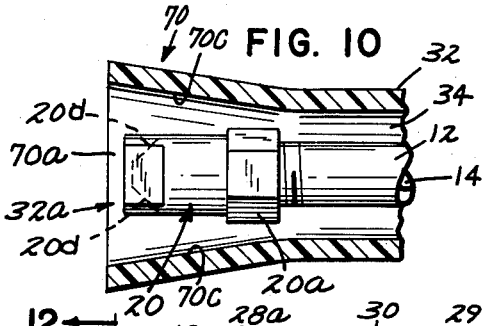
FIG. 11
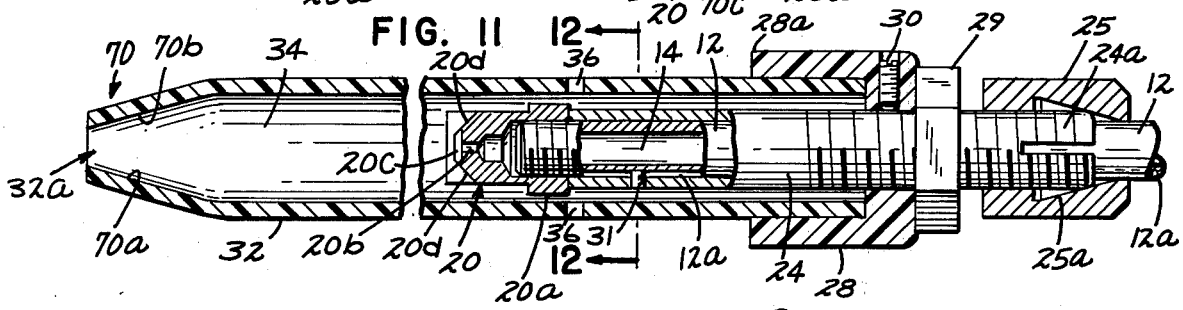
FIG. 12
FIG. 13
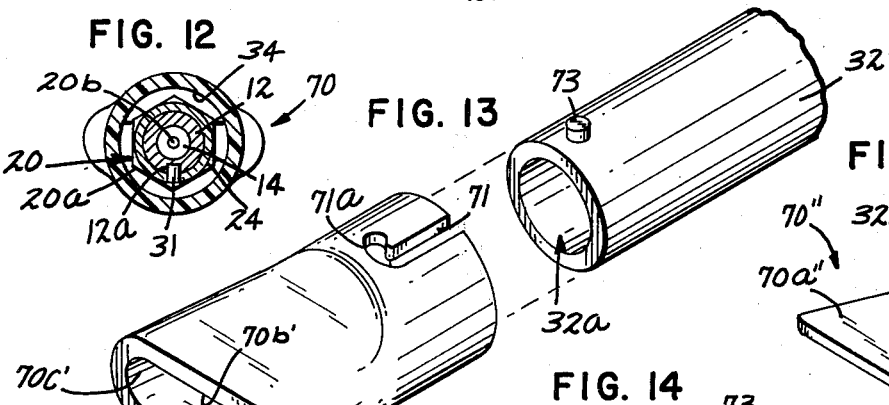
FIG. 15
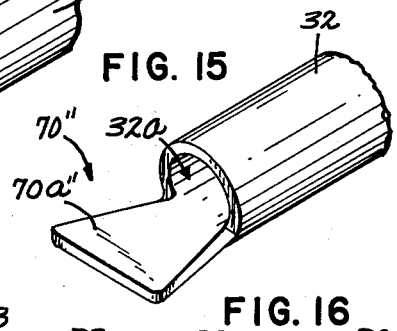
FIG. 14
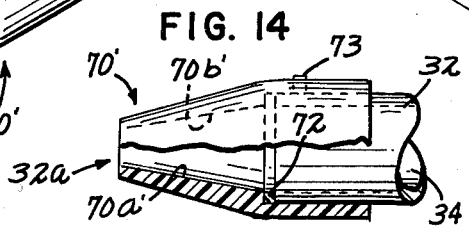
FIG. 16
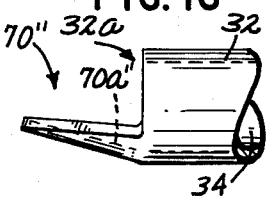

SPRAY AND FOAM PRODUCING NOZZLE APPARATUS

This case is a Continuation-In-Part of co-pending patent application Ser. No. 612,865, filed on Sept. 12, 1975 by the Applicants hereof now U.S. Pat. No. 3,961,754.

BACKGROUND OF THE INVENTION

1. Field of the Invention

This invention relates generally to nozzle apparatus, and more particularly to a nozzle apparatus for cleaning applications, which is rapidly convertible between spray and foam forming modes of operation.

2. Description of the Prior Art

Industrial cleaning apparatus has traditionally employed the principle of directing high pressure spray of relatively dilute detergent solutions against the article to be cleaned, thus relying upon the hydraulic cleansing action of the spray. In several applications, such as in conveyor type spray washers (e.g. dishwashers, hydrobottle washers etc.) the production of foam during the cleaning operation is generally undesirable and defoaming agents are typically used to minimize foam formation. In other applications such as in the cleaning of carpets and upholstery it has been found that foam cleansers used in combination with brushing/scrubbing action are effective to suspend the soil removed from the carpet or upholstery in the foam. When the foam is allowed to dry, the foam/soil residue can be simply vacuumed away. In such applications, the foaming agent is desirably of a type which will dry to a powder so that it can be completely removed when dry.

The use of foam in cleaning food handling equipment and other industrial hard surface applications, however, is relatively new in the art. It has now been found that in certain industrial cleaning applications particularly in those requiring the cleaning of large surfaces or hard to reach geometrical configurations, it is desirable to use a non-drying foam cleansing agent which will cling to the surface to be cleaned for extended periods of time, prolonging the contact between the soil and detergent within the foam for solvation, hydration or emulsification of the soil. In many applications, foam cleansing techniques can be significantly more efficient and less expensive to use than the prior art high pressure hydraulic cleansing techniques. With the use of hydraulic cleansing techniques, large volumes of relatively dilute detergent solutions are directed at high pressure against the object to be cleansed. With such techniques, the cleansing of stubborn soil requires the hydraulic spray to be directed at a specific area for extended periods of time, prolonging the cleansing operation. Further, with use of conventional high pressure cleaning operations, the high pressure spray nozzle must typically be held within a foot of the surface to be cleaned to provide effective hydraulic cleansing action.

The use of foam cleansing techniques for hard surfaces overcomes the aforementioned disadvantages of hydraulic cleansing techniques. When cleaning with foam, which is highly visible to the operator, the operator knows exactly what areas have been exposed to the cleaner thus insuring against missed areas. Likewise, the adequacy of rinsing is visually detectable, enabling an operator to completely rinse off any residues of cleansing solution from the object being cleaned. Since the foam clings to vertical and overhead surfaces, such surfaces are particularly adapted for cleansing by this technique. Further, since the cleansing action is minimally dependent on any hydraulic action, the "reach" of a foam producing nozzle can be extended outwardly from 10 to 20 feet making it possible to clean relatively remote areas without the need for the operator's physical presence directly adjacent the object to be cleaned. Foam cleaning enables significant time to be saved in the cleansing of larger articles since an operator can start with foam applications from one end of the article to be cleaned, work his way to the far end, and simply return to his starting point and begin rinsing operations. No wasted time for prolonged spraying efforts in any one area to remove stubborn soil is required. Also, since the same volume of detergent solution may clean a significantly greater area with the foam generating operations as compared to high-pressure spray producing applications, the detergent concentration level within the foam can be significantly increased to insure high cleansing action thereby, in a highly economical manner.

Prior art cleansing apparatus has conventionally been designed to accommodate a fixed type of nozzle designed either to eject high-pressure spray solutions for hydraulic cleansing action or to produce and to eject a foam-type cleanser. The foam producing nozzles have been provided with various tips which may be secured to the ejection port of the nozzle to vary the foam ejection pattern emitted therefrom. It is highly desirable for an operator to use the same nozzle for directing cleansing foam against the object to be cleaned and for directing a rinse solution for removing the foam from the object. However, the prior art is void of any such nozzle apparatus.

Foam producing nozzle configurations have also appeared for use in applications other than for cleansing. The largest use of such nozzles has been in the fire extinguishing art and in the distribution of herbicides and insecticides. As in the cleansing art, however, such nozzles have been designed for a single purpose use of producing either foam or pressurized sprays.

The present invention overcomes the above-mentioned shortcomings of the prior art nozzle structures for use with pressurized spray and/or foam producing cleansing apparatus. The present invention provides a highly versatile hand-held nozzle apparatus which is usable with a detergent solution source for enabling an operator to selectively direct against the target area either a pressurized spray for hydraulic cleansing or rinsing action, or a dry (stiff) foam for foam cleansing action. The nozzle apparatus of this invention is rapidly convertible between its pressurized spray and its foam producing modes, filling a long-felt need for such a device in the art.

SUMMARY OF THE INVENTION

In the present invention, a spray and foam producing nozzle apparatus is rapidly convertible, while the device is operatively ejecting cleansing solution therefrom, between a pressurized spray mode for hydraulic cleansing action and a foam-producing mode for foam cleansing action. The output nozzle apparatus is supplied with cleansing solution or rinsing solution directed under pressure from a supply source. The source can either be of a high-pressure output type or of a low-pressure output type, of the order of magnitude of water pressure form a water main, and can be either portable or stationary.

The convertible nozzle configuration resembles a conventional pressurized wand-type apparatus, having an elongated first conduit member connected to a pistol grip handle for enabling hand-carrying thereof and operative directional aiming of the elongated conduit portion. The pressurized solution enters the first elongate conduit by means of an inlet port and is projected therethrough to an outlet port at one end thereof. A spray-forming nozzle connected at the outlet port forms the pressurized solution into a spray and directs the spray longitudinally outward therefrom.

A second elongate tube assembly sized to overlie the first conduit shaft and attached nozzle, is slidably mounted in coaxial alignment to the first conduit portion. A clamping mechanism at one end of the outer tube enables the tube to be positioned in retracted and extended positions relative to the underlying first conduit shaft. In its retracted position, the outer tube assembly freely exposes the spray-forming nozzle to permit uninterrupted spray-forming action thereby. In its extended position, the outer tube encompasses and extends beyond the spray-forming nozzle. When the outer tube is disposed in the extended position, spray ejected from the spray-forming nozzle is turbulently advanced through the outer tube. A plurality of holes through the outer tube permit air to be drawn into the internal chamber formed by the outer tube, which aspirates with the turbulent spray to produce a foam, which is directionally projected from the outer tube toward a target area. Foam is produced in this mode of operation whenever the solution being sprayed through the spray forming nozzle contains a surfactant. The clamping mechanism enables an operator to rapidly extend or retract the outer tube to respectively convert between foam-producing and spray modes of operation.

Foam dispersing means are provided at the outlet port of the outer tube for controllingly spreading the foam ejected from the outer tube in a predetermined shaped pattern spread. The foam dispersing means is operative to spread the material ejected from the outer tube only when the apparatus is operative in its foam-producing mode and does not affect the spray pattern of the apparatus when operated in its spray mode. The foam dispersing means may comprise an integral part of the outer tube or may be provided as a removable attachment thereto.

While the invention will be disclosed with respect to a preferred embodiment thereof, employing specific material in its construction, it will be understood that other types of materials can be equally well employed within the spirit and intent of this invention. Further, while specific dimensions, pressures and geometrical configurations will be described with respect to various elements of the preferred embodiment, it will be understood that such dimensions, pressures and geometrical configurations are design parameters which can be varied and combined in numerous fashions to achieve the intent and purposes of this invention.

BRIEF DESCRIPTION OF THE DRAWING

Referring to the drawing, wherein like numerals respresent like parts throughout the several views:

FIG. 1 is a side elevational view of the spray and foam-producing nozzle apparatus of this invention;

FIG. 2 is an end view of the spray-forming nozzle portion of the apparatus disclosed in FIG. 1;

FIG. 3 is a cross sectional view generally taken along the line 3—3 of the spray-forming nozzle of FIG. 2;

FIG. 4 is a cross sectional view generally taken along the line 4—4 of the spray-forming nozzle of FIG. 2;

FIG. 5 is a cross sectional view generally taken along the line 5—5 of the apparatus disclosed in FIG. 1, illustrating the outer foam-producing member in its extended position;

FIG. 6 is a block diagram representation of the spray and foam-producing nozzle apparatus in combination with a typical high-pressure solution supply unit;

FIG. 7 is a side elevational view of the spray and foam-producing nozzle apparatus of this invention, including a first embodiment of foam-dispersing nozzle means;

FIG. 8 is an end view of the foam-dispersing nozzle portion of the apparatus disclosed in FIG. 7;

FIG. 9 is a cross sectional view generally taken along the line 9—9 of the spray and foam-producing nozzle apparatus disclosed in FIG. 8;

FIG. 10 is a cross sectional view generally taken along the line 10—10 of the spray and foam producing nozzle apparatus disclosed in FIG. 8;

FIG. 11 is cross sectional view generally taken along the line 11—11 of the spray and foam-producing nozzle apparatus disclosed in FIG. 7, as it would appear in the foam producing mode of operation;

FIG. 12 is a cross sectional view generally taken along the line 12—12 of the apparatus disclosed in FIG. 11;

FIG. 13 is perspective view of a second foam dispersing nozzle apparatus of the present invention;

FIG. 14 is a view in side elevation with portions thereof broken away, of the foam dispersing nozzle apparatus disclosed in FIG. 13;

FIG. 15 is a perspective view of a third embodiment of foam dispersing nozzle apparatus of this invention;

FIG. 16 is a view in side elevation of the foam-dispersing nozzle apparatus disclosed in FIG. 15;

FIG. 17 is a view in top elevation of a fourth embodiment of a foam dispersing apparatus of this invention; and FIG. 18 is a view in side elevation of the foam-dispersing apparatus disclosed in FIG. 17.

DESCRIPTION OF THE PREFERRED EMBODIMENT

Referring to the Figures, there is generally illustrated at 10 in FIG. 1 a preferred embodiment of a convertible spray and foam-producing nozzle apparatus constructed according to the principles of this invention. The spray and foam-producing apparatus is shaped in what is typically referred to as a wand configuration, having a first elongate cylindrical rigid conduit 12 defining an internal passageway 14 extending therethrough from an inlet port 15 to an outlet port 16 each located, in the preferred embodiment, at opposite ends of the first conduit member 12. The first conduit member 12 passes through a pistol grip handle 18 which enables an operator of the device to hand-carry the assembly and to accurately point or aim the outlet port 16 of the first conduit member 12 so as to direct the flow emanating therefrom as desired.

A spray-forming nozzle 20 is connected to the first conduit member 12 at its outlet port 16. The nozzle 20 is threaded to the first conduit shaft 12 at its outlet port 16 by means of a hexagonal head nut portion **20*a*. The spray-forming nozzle 20 may be of any construction which forms a spray of solution passing under pressure therethrough and which directs the formed spray longitudinally outward therefrom. In the preferred embodiment, the spray-forming nozzle 20 comprises what is known in the art as a V-jet nozzle having a central passageway therethrough leading from the larger diameter outlet port 16 of the first conduit shaft 12 to a significantly smaller nozzle opening 20***b*.

The ejection end of the nozzle 20 includes a pair of flow directing ramp surfaces 20*c* located directly adjacent the nozzle outlet opening 20*b*. Each of the flow directing ramp surfaces 20*c* is positioned in a plane inclined to the horizontal (as viewed in FIGS. 1, 2 and 3) so as to direct the spray of solution ejected from the nozzle outlet 20*b* at a predetermined angle with respect to the longitudinal axis of the nozzle. The nozzle 20 also includes a pair of side ramps 20*d* extending outwardly from the flow directing ramp surfaces 20*c* in planes respectively and symmetrically inclined relative to a vertical longitudinal plane (as viewed in FIGS. 1, 2 and 3) of the nozzle, 20. The flow directing and side ramps 20*c* and 20*d* respectively, in combination, produce and direct a spray from that solution passing through the nozzle opening 20*b*, which is directed longitudinally outwardly, therefrom in a fan-shaped V pattern with respect to the longitudinal horizontal plane of the nozzle 20.

A support sleeve member 24 coaxially overlies the first conduit shaft 21 for free sliding engagement therealong. Forward sliding motion of the sleeve 24 relative to the underlying first conduit member 12 is restricted, as illustrated in FIG. 5, by its engagement with the hexagonal nut portion 20*a* of the nozzle 20. The rearward end of the sleeve 24 is bifurcated to form a plurality of collet finger members 24*a* which are radially movable with respect to the longitudinal axis of the sleeve 24. The outer surface of the collet sleeve 24 adjacent the collet finger members 24*a* is threaded to accept a collet nut 25. The outer surface of the collet nut 25 is knurled to enable an operator to easily grasp and thread the nut 25 relative to the sleeve member 24. The collet nut 25 has an internal truncated conical surface 25*a* symmetrically disposed about the longitudinal axis of the nut for engaging the collet finger members 24*a*.

The collet fingers 24*a* are radially movable with respect to the longitudinal axis of the sleeve 24 such that when the collet nut 25 is threaded onto the sleeve 24 the collet finger members 24*a* are depressed in latching engagement against the outer surface of the first cylindrical shaft member 12 so as to frictionally secure the sleeve 24 to the underlying shaft 12. As the collet nut 25 is threaded in the direction so as to remove the conical surface 25*a* from engagement with the collet finger members 24*a*, the collet finger members 24*a* act under their internal bias tension to release their frictional hold upon the underlying shaft 12 to enable free sliding movement of the sleeve 24 relative to the underlying shaft 12.

An end cap 28 is threaded to the support sleeve member 24 and is securely affixed thereto by means of a lock nut 29, also threaded to the sleeve 24, and by a set screw 30 within the end cap 28. The end cap 28 has a forwardly disposed cylindrical portion 28*a*.

An elongate second cylindrical tube member 32 is secured to the inner surface of the cylindrical extended portion 28*a* of the end cap 28. The inner periphery of the elongate outer tube 32 defines an internal chamber 34 closed at one end by the end cap 28 and open at the opposite extremity forming an outlet port 32*a* of the outer tube 32. The second cylindrical member 32 may be made of semi-rigid or rigid material and has an inner diameter sized to freely pass over the hexagonal nut portion 20*a* of the nozzle 20, see FIGS. 2 through 5. The length of the cylindrical outer tube 32 is sized such that when the sleeve and collet assembly 24 and 25 respectively are retracted in their rearmost position as illustrated in FIG. 1, the outlet port of the outer cylindrical tube 32 is spaced back from the ejection end of the nozzle 20 so as to permit normal spray-forming action by the nozzle 20. A pair of holes 36 radially extend through the cylindrical walls of the elongate outer tube member 32 at diametrically opposite positions thereof and are longitudinally spaced from the end cap 28 such that they open into the inner chamber 34 of the tube 32 just rearward of the hexagonal nut 20*a* of the nozzle 20 when the sleeve and collet assembly 24 and 25 respectively are positioned in their maximally extended position as illustrated in FIG. 5.

A block diagram of a typical source for supplying a detergent or rinse solution under pressure to the convertible spray and foam producing apparatus 10 is illustrated at 40 in FIG. 6. Referring thereto, the solution supply source illustrated at 40 is of the type which could typically be employed for use with a portable washing apparatus which uses a relatively small one or two gallon reservoir of concentrated detergent solution. An example of such an apparatus is the Porta-Washer, ®• Model P manufactured by Economics Laboratory, Inc. However, as will become apparent upon a more detailed description herein, the invention is equally well applicable to its use with stationary solution supply systems as well as with low-pressure supply systems operating directly off of normal water inlet supply pressures.

Referring to FIG. 6, the solution supply source 40 includes a pump 42 having a first intake port 42*a*, a second intake port 42*b* and an outlet port 42*c*. The intake port 42*a* of the pump 42 is connected by means of a conduit 43 to an appropriate fresh water source such as a standard water line or the like having a typical water line pressure of 30 to 40 p.s.i.. In the preferred embodiment, the pump 42 is of a type having a capability of developing and maintaining an output pressure of approximately 700 p.s.i.. The outlet port 42*c* of the pump 42 is connected by means of a conduit 44 to the inlet port 45*a* of an unloader valve 45. The unloader valve 45 also has a main outlet port 45*b*, a secondary outlet port 45*c* and a pressure adjustment means (not illustrated). The secondary outlet port 45*c* of the unloader valve 45 is connected by means of a bypass or return path conduit 46 to the second intake port 42*b* of the pump 42. The unloader valve may be of any type standard in the industry which functions to normally provide flow from its inlet port 45*a* to its main outlet port 45*b* whenever the back-pressure at its outlet port is below a predetermined adjustable level, and operates to provide bypass flow from its inlet port 45*a* to its secondary outlet port 45*c* to provide a closed loop for fluid flow between the unloader valve 45 and the pump 42 whenever the back-pressure at its main outlet port 45*b* exceeds a predetermined value.

The main outlet port 45*b* of the unloader valve 45 is connected to a conduit 47 which is bifurcated into first and second branches 47*a* and 47*b* respectively. The first branch 47*a* of the conduit 47 is directly connected to a first inlet port 48*a* of an aspirator unit 48. The aspirator 48 further has a second inlet port 48*b* and an outlet port 48*c*. The aspirator 48 is of a type well-known in the art which functions in response to sufficient fluid flow between its first inlet port 48*a* and its outlet port 48*c* to draw solution at a predetermined rate into its second inlet port 48*b* for mixing or aspirating the draw-in solution with the main fluid flowing out of the outlet port 40*c*.

The second inlet port 48*b* of the aspirator 48 is connected by means of a conduit 49 terminating at a strainer 50 in a reservoir 52 for concentrated detergent solution generally designated at 53.

The second branch 47*b* of the conduit 47 is connected by means of a "selection" valve 55 to a first branch 57*a* of a conduit 57. The selection valve 55 is in the preferred embodiment, a simple ball-valve which opens or closes the fluid flow path between the conduits 47*b* and 57*a*. The conduit 57 further has a second branch 57*b* connected to the outlet port 48*c* of the aspirator 48. The first and second branches 57*a* and 57*b* of the conduit 57 join at an output coupling 58 of the solution supply source 40.

The coupling 58 is connected, in the preferred embodiment, by means of a high-pressure hose 60 to a "shut-off" valve 62 to the inlet port 15 of the first conduit shaft 12 of the convertible spray and foam producing apparatus 10. The shut-off valve 62 is in the preferred embodiment, a ball-valve which operates simply to open and close the fluid flow path between the hose 60 and the inlet port 15 of the conduit 12.

A first embodiment of a convertible spray and foam-producing nozzle apparatus which employs foam pattern dispersing means is illustrated in FIG. 7. Referring thereto, the leading end of the second cylindrical tube member 32 is flattened at 70 for changing the cylindrical shape of the inner chamber 34 of the tube member 32 to an elongate generally rectangular opening symmetrically disposed about the longitidinal axis of the tube member 32. The shaped end 70 of the second tube member 32 comprises a foam pattern shaping member operable to direct the foam ejected from the outlet port 32*a* of the tube member 32 in a fan-shaped pattern. The foam-dispersing end 70 of the second cylindrical tube member 32 generally has a floor portion 70*a* and a roof portion 70*b* converging toward one another in symmetrical fashion about the longitudinal axis of the second tube member 32. The foam dispersing end 70 further has a pair of outwardly diverging side walls 70*c*.

In the preferred embodiment, the inside dimension of the flattened foam dispersing end 70 of the second tube 32 is sized to cooperatively mate with the spray-forming nozzle 20 such that when the second cylindrical tube member 32 is retracted in its rearmost position (i.e. when the apparatus is in the spray-forming mode of operation), the spray pattern 100 emitted from the outlet port 20*b* of the spray-forming nozzle 20 is not retarded or impeded by the floor or roof portions 70*a* and 70*b* respectively of the foam-dispersing end 70 of the second tube member 32 (see FIG. 9). When the outer tube member 32 is partially or fully extended in the foam-producing mode of operation, however, the floor and roof portions 70*a* and 70*b* of the foam dispersing end 70 compress the emitted foam pattern in the vertical direction (as viewed in FIGS. 7–9), and the pair of diverging side walls 70*c* act to spread the emitted foam pattern in the horizontal direction (as viewed in FIGS. 7–9).

In the preferred embodiment, since a V-jet nozzle 20 is employed for forming the spray pattern, an attitude orienting means is employed to align the foam dispersing end 70 of the outer cylindrical tube member 32 with the V-jet nozzle 20, as illustrated in FIGS. 9–11, such that the relative orientation of the V-jet nozzle 20 and foam-dispersing end 70 of the outer tube member 32 is maintained when the outer tube 32 is retracted in its rearmost position as illustrated in FIGS. 9 and 10. To maintain the relative orientation between the outer tube 32 and the first conduit member 12 a channel or race 12*a* (see FIGS. 11 and 12) is longitudinally formed within the outer wall of the first conduit member 12. An alignment pin 31 is mounted within the sleeve member 24 and projects toward and into sliding engagment with the race 12*a* of the first conduit member 12 to maintain the relative rotational orientation of the outer tube member 32 with respect to the first conduit member 12 during longitudinal movement of the outer tube member 32 between its extending and retracted positions. This alignment insures that spray pattern 100 emitted from the nozzle 20 will never engage the surfaces of the foam-dispersing end 70 of the second cylindrical tube member 32 when the tube member 32 is disposed in its fully retracted position.

Referring to FIG. 13, the foam-dispersing end portion of the second cylindrical tube member 32 is illustrated as a detachable foam-dispersing nozzle element 70′. By designing the foam-dispersing end 70′ of the outer tube member 32, a large number of different foam-dispersing patterns can be generated with a single spray and foam-producing apparatus 10, simply by attaching that foam-dispersing nozzle member configuration which will provide the desired foam-pattern. Referring to FIGS. 13 and 14, the foam-dispersing nozzle member 70′ has a bayonet-type slot 71 passing through its wall and extending longitudinally from the back edge of the foam-dispersing nozzle and terminating at an offset latching portion 71*a*. The inner diameter of the rear portion of the foam-dispersing nozzle 70′ is sized to snugly frictionally engage the outer wall of the second tube member 32, and is flanged at 72 for cooperative seating engagement with the end wall portion of the second tube member 32. A mounting stud 73 projects from the second tube member 32 adjacent its leading edge and is sized to cooperatively matingly engage the slot 71 of the foam-dispersing nozzle member 70′ such that the nozzle member 70′ is fixedly attached in bayonet-type manner to the leading end of the second tube member 32 when the mounting stud 73 is cooperatively engaged within the offset latching portion 71*a* of the slot 71. While a particular shape of foam-dispersing nozzle portion 70 and 70′ have been illustrated in the Figures, it will be understood that other variations of the foam-dispersing end of the outer tube (both as an integral part thereof and as a removable attachment thereto) can be configured within the spirit and intent of this invention, so as to provide any desired foam-spreading pattern.

A third embodiment of a foam-dispersing member suitable for forming an integral part of or as an attachment to the end of the outer tube member 32 is illustrated at 70″ in FIGS. 15 and 16. Referring thereto, the foam-dispersing member 70″ comprises only a lower or floor member 70*a″* inclined in converging manner toward the longitudinal axis of the outer tube 32 so as to intercept and to direct the longitudinal motion of foam emitted from the outlet port 32*a* of the outer cylindrical tube member 32. The first through third embodiments of the foam-dispersing apparatus are generally operative to form a fan-shaped foam pattern from the foam ejected from the outlet port 32*a* of the outer cylindrical tube member 32.

A fourth embodiment of a foam-dispersing apparatus mounted at the leading end of the outer cylindrical tube 32 is illustrated in FIGS. 17 and 18. Referring thereto, an air-directing nozzle 70''' is mounted to the outer cylindrical tube 32 at or adjacent its leading end and is disposed so as to emit a narrow fan-shaped pattern of compressed air (generally designated at 102 longitudinally outward from and converging toward the longitudinal axis of the outer tube member 32*a*. The air stream 102 passing from the air nozzle 70''', is of sufficient air-pressure to act as a barrier, (much in the same way as the physical floor member 70*a''* of the foam dispersing nozzle member 70'') to intercept and to redirect the foam passing at a substantially lower pressure out of the outlet port 32*a* of the cylindrical outer tube 32. The air nozzle 70''' is connected by means of a conduit 75 and a shut-off valve schematically illustrated at 76, to a source of compressed air (not illustrated). It will be understood that while a particular air-nozzle configuration and thin fan-shaped compressed air pattern resulting therefrom have been disclosed, that the general concept of engaging and redirecting in a predetermined pattern spread, the output foam ejected from the spray and foam-producing apparatus, by means of a barrier of compressed air is applicable to many other variations and configurations of both air compressor nozzles and their respective air patterns. It will be understood that with the use of the compressed air embodiment of the foam-dispersing apparatus, that the shut-off valve 76 is opened to form the compressed air deflection barrier only when the outer cylindrical tube 32 is operably extended in its foam-producing mode of operation.

OPERATION OF THE PREFERRED EMBODIMENT

As previously discussed, the convertible spray and foam producing nozzle apparatus 10 of this invention can be employed with any pressurized source of detergent solution to direct that solution in either a pressurized spray or foam condition at the object to be cleaned. The apparatus is preferably usable for combined use with a high pressure solution supply source (e.g. on the order of 300 to 700 p.s.i.), but can also be employed for use with fairly low pressure solution supplies as would be derived from direct use with a 40–60 p.s.i. source such as taken directly from a water main. With reference to its preferred use with a high-pressure supply system as illustrated in FIG. 6, the pump 42 drives water from its intake port 42*a* through the unloader valve 45 to the conduit 47. When the selection valve 55 is closed, indicating a "Wash" selection, the high-pressure water flow from the conduit 47 is directed through the aspirator 48, to the output coupling of the supply unit 40. As the high-pressure water flow is forced through the aspirator 48, a predetermined amount of the concentrated detergent solution 53 within the detergent reservoir 52 is pulled through the strainer 50 and connecting conduit 49 into the aspirator 48 and is mixed with the water passing therethrough.

When the selection valve 55 is positioned in an open position, designating a "Rinse" cycle, the high-pressure water passing through the conduit 47 is primarily bypassed around the aspirator 48 and through the selection valve 55 to the output coupling 58. While a small amount of fluid flow is present through the aspirator 48, the rate of flow is insufficient to cause detergent solution from being drawn into its inlet port 48*b*. Therefore, for all practical purposes, the aspirator is essentially inoperative in this position.

When the shut-off valve 62 is closed, blocking fluid flow into the inlet port 15 of the conduit 12, the back-pressure at the main outlet port 45*b* of the unloader valve 45 causes the unloader valve to divert fluid flow from its inlet port 45*a* through the bypass conduit 46 to the second intake port 42*b* of the pump 42. The pump can be operated in this mode of operation for short periods of time in which it merely recycles water between its outlet port 42*c* and its second intake port 42*b*. When the shut-off valve 62 is opened, the solution provided from the supply source 40 is allowed to enter the inlet port 15 of the first conduit 12 and to proceed through the internal passageway 14 thereof to the spray-forming nozzle 20.

When the sleeve and collet assembly 24 and 25 are positioned in their fully retracted position, the outer cylindrical tube 32 overlies the first cylindrical shaft 12 along its length such that the nozzle 20 is exposed beyond the output end 32*a* of the outer tube 32. This is the "Spray" cleansing mode of operation for the device, and the solution passing through the inner tube 12 is ejected from the nozzle opening 20*b* of the nozzle 20 in a V-shaped fan-out spray pattern as directed by the flow directing ramp surfaces 20*c* of the nozzle 20. In this mode of operation, the spray and foam producing apparatus 10 acts as a conventional hard-spray cleaning wand for directing a pressurized spray for washing or rinsing via hydraulic action.

The convertible spray and foam producing apparatus 10 can be rapidly converted to its "Foam" producing cleansing mode by partially unscrewing the collet nut 25 so as to release the gripping pressure of the collet finger members 24*a* from the underlying cylindrical shaft 12 and by sliding the entire collet (25), sleeve (24), end cap (28) and outer cylindrical tube (32) in the longitudinal direction of spray (i.e. from right to left in FIG. 1) such that the outer tube 32 encompasses the nozzle 20, with the outlet port 32*a* of the outer tube 32 longitudinally extending beyond the nozzle 20. The collet nut 25 may be tightened anywhere along the longitudinal length of the first conduit 12, as restrained by the length of the sleeve 24, to position the outlet port 32*a* of the outer tube 32 at an infinite number of positions longitudinally spaced from the nozzle 20 in the direction of solution spray. However, it has been experimentally determined that a foam having dryer (i.e. lower weight) characteristics is produced when the outer tube 32 is positioned in its maximally extended position as illustrated in FIG. 5. When the outer tube 32 is positioned in its extended position, the spray from the nozzle 20 is violently directed against the inner chamber walls 34 of the outer tube 32, creating severe turbulence therein. Air is drawn into the chamber 34 through the holes 36 within the tube 32 and is aspirated with the detergent or surfactant bearing solution emanating from the nozzle 20 to produce foam.

The foam thus produced is directed outwardly from the outlet port 32*a* of the outer tube 32 and is projected under force against a remotely located target area. The apparatus 10 can be rapidly converted from its spray mode to its foam producing mode while the shut-off valve 62 is open. Thus an operator can initially cleanse or rinse an object under the spray mode of operation, can convert immediately to the foam producing mode of operation to apply a layer of concentrated cleansing foam to the object, and can thereafter, without interruption, reconvert back to a spray mode of operation to rinse the foam from the target area.

As disclosed in FIGS. 7–18, foam-dispersing means may be incorporated at the outlet port 32*a* of the outer cylindrical tube 32 to intercept and to direct the foam emitted from the outlet port 32*a* into a predetermined pattern spread. In the preferred embodiment, the foam dispersing means disclosed are operative to shape the ejected foam into a fan-shaped pattern which provides the advantages of enabling greater foam coverage of the surface at which the foam is directed, for each "pass" of the nozzle apparatus 10, and provides more uniform foam coverage of the target area, resulting in cost savings in both time and cleansing materials required for effectively covering the target area.

When formed as an integral portion of the outer tube member 32, the foam-dispersing means enables uninterrupted conversion between the "spray" and "foam" producing modes of operation of the nozzle apparatus 10. Alternatively, however, the foam-dispersing means may comprise a rapidly detachable foam-shaping nozzle configured for attachment to the end of the outer cylindrical tube 32, as illustrated in FIGS. 13 and 14. The detachable foam-shaping nozzle feature enables the user of the apparatus to select any one of a plurality of such foam-shaping nozzles 70' for providing a number of different foam patterns, each particularly suitable for specific cleansing applications. It will be understood, however, that when attaching or disconnecting the foam-forming nozzle portion 70' the shut-off valve 62 must momentarily be closed to prevent flow of spray or foam from the output port 32*a* of the outer tube 32 during the connect/disconnect process.

The foam dispersing apparatus disclosed in FIGS. 15–18 operate to partially engage the main stream of foam ejected from the outlet port 32*a* of the outer tube 32 and to redirect a portion of that foam flow in a spreading pattern.

While the invention has been described with respect to its use with a particular type of portable supply apparatus 40, it will be noted that other supply apparatus could equally well be used. For example, a stationary-type of supply apparatus could be used, wherein the detergent solution is drawn out of a large (55 gallon) drum; in such case, an aspirator 48 would not be required. Without the use of an aspirator, the output working pressure of the apparatus can be maintained at the high pressure output level from the pump (e.g. at 700 lbs. in the preferred embodiment) when operating in either the spray or foam producing modes.

It will be apparent that a number of design parameters can be changed without departing from the spirit and intent of this invention. For example, the length of the outer tube 24 can be varied to affect the quality of foam produced and to determine the "reach" (i.e. the distance over which the foam can be projected) of the foam producing apparatus. A longer outer tube 32 will provide a longer reach. Similarly, as the length of the outer tube 32 is decreased, the quality of the foam produced thereby proportionately changes from a dry foam to a wet foam as a result of the incomplete aspiration between the air and liquid solution within the chamber 34. Further, different combinations of spray-forming nozzles 20 and outer tube 32 dimensions can be employed to produce various foam qualities. In the preferred embodiment, the V-jet nozzle used develops at 25% angle (with respect to the longitudinal nozzle axis) spray with an output of 0.6 gallons per minute at 40 p.s.i. pressure. Also, the size and location of the air intake holes 36 through the outer tube 32 can be varied to effect various aspiration effects within the inner chamber 34 of the tube 32. Further, the shape configuration, and apparatus used to disperse the ejected foam into a predetermined pattern spread can be varied within the scope of this invention.

While we have disclosed specific embodiments of our invention, it is to be understood that this disclosure is for the purposes of illustration only. Other modifications of the invention will be apparent to those skilled in the art in light of the foregoing description. This description is intended to provide concrete examples of embodiments which clearly disclose the present invention. Accordingly, the invention, is not limited to any one particular embodiment, but is limited only by the broad scope of the appended claims.

What is claimed is:

1. A convertible spray and foam producing nozzle apparatus, comprising:

a. spray-forming nozzle means having an inlet port suitable for receiving a pressurized flow of surfactant bearing fluid therethrough, for forming a spray from fluid received by said inlet port and for directionally projecting said spray in a predetermined pattern outwardly from said nozzle means;

b. foam-forming means cooperatively connected with said spray-forming nozzle means and operatively movable between first and second positions relative to said spray-forming nozzle means for selectively producing foam from said spray, said foam-forming means being operative in said first position to enable said spray-forming means to uninterruptedly directionally eject its produced spray pattern externally of said nozzle apparatus, and being operable in said second position to intercept said spray, to convert said spray into a foam and to directionally project in a generally fan-shaped pattern said foam outwardly from said nozzle apparatus; and c. positioning means cooperatively connecting said spray-forming nozzle means and said foam-forming means for selectively securing said foam-forming means relative to said spray-forming means, between its said first and second positions.

2. The combination with a convertible spray and foam producing nozzle apparatus of the type characterized by (i) an elongate tube member having an outlet port, and (ii) means for selectively ejecting under pressure a surfactant containing liquid, either as a spray or as a foam formed from the spray, of: foam pattern shaping means cooperatively connected adjacent the outlet port of said elongate tube member for shaping said ejected foam into a fan-shaped foam pattern directed longitudinally outward from said outlet port.

3. The combination as recited in claim 2, wherein said foam pattern shaping means comprises compressed air nozzle means for injecting a deflection barrier of compressed air into the path of said ejected foam, to redirect in a predetermined fan-shaped pattern at least a portion of said ejected foam.

4. The combination as recited in claim 2, wherein said foam pattern shaping means comprises a nozzle-like member mounted at the outlet port of said elongate tube member and defining at least one deflection surface for engaging and redirecting at least a portion of said foam ejected from said outlet port in said predetermined fan-shaped pattern.

5. The combination as recited in claim 4, wherein said nozzle-like member is detachably connected to said elongate tube member at said outlet port.

6. A spray and foam producing nozzle apparatus, comprising:

a. an elongate rigid conduit member having a passageway extending from an inlet port to an outlet port spaced from said inlet port;

b. a spray producing nozzle connected to said conduit at its said outlet port, suitable for forming and for directing a spray outwardly therefrom of solution passing under pressure through said passageway; and c. means slidably attached in overlying engagement with said conduit member for selectively producing foam from said spray and for directionally ejecting said foam outwardly from said nozzle apparatus in a predetermined spread pattern.

7. A spray and foam producing nozzle apparatus as recited in claim 6, wherein said foam producing means comprises:

a. an elongate foam producing member slidably attached in overlying engagement with said conduit member, said foam producing member being positionable in a first position along said conduit member so as to enable said nozzle to direct its spray in unimpeded fashion outwardly therefrom, and being movable to a second position encompassing said nozzle for converting said spray from said nozzle into foam and for longitudinally directing said foam along said elongate foam producing nozzle;

b. foam pattern shaping means operatively connected to said foam producing member for ejecting in predetermined fan-shaped manner said foam outwardly from said nozzle apparatus; and c. means for selectively securing said foam producing member relative to said conduit member between and including its said first and said second positions.

8. A spray and foam producing nozzle apparatus as recited in claim 7, wherein said elongate conduit member comprises a first generally cylindrical tube member having said outlet port forming one end thereof; wherein said foam producing member comprises a second generally cylindrical tube member coaxially aligned with at least a portion of said first cylindrical member and sized for cooperative sliding engagement therewith between said first and second positions; and wherein said foam pattern shaping means defines at least one deflection surface extending from said foam producing member and disposed to engagably redirect that portion of said foam passing through said second tube member and engaging said deflection surface, in a predetermined spread pattern.

9. A convertible spray and foam producing nozzle apparatus, comprising:

a. a first rigid tube member defining an internal passageway extending from an inlet port to an outlet port at one end thereof, said first tube member having an elongate generally cylindrical shaft portion adjacent said outlet port thereof;

b. a spray-forming nozzle connected to said first tube member at its said outlet port for forming a spray of fluid passing under pressure through said outlet port and for directing said spray in a predetermined pattern longitudinally outward from said spray-forming nozzle;

c. foam forming means movably attached to said first tube member between first and second positions for selectively forming foam and for ejecting said foam in the direction longitudinally outward from said spray-forming nozzle, said foam forming means being operable in said first position to enable uninterrupted spray ejection from said spray-forming nozzle, and being operable in said second position to intercept and to convert said spray into foam;

c. foam dispersing means operatively mounted to said foam forming means for intercepting and directionally shaping said foam into a fan-shaped pattern; and d. means connecting said foam forming means to said first tube member for securing said foam forming means between its said first and second positions.

10. A convertible spray and foam producing nozzle apparatus as recited in claim 9, wherein said foam dispersing means defines at least one deflection surface projecting from said foam dispersing means and into the path of said ejected foam for engaging and redirecting at least a portion of said ejected foam into said fan-shaped pattern.

11. A convertible spray and foam producing nozzle apparatus as recited in claim 10, wherein said foam dispersing means includes compressed air nozzle means for injecting a deflection barrier of compressed air of predetermined shape into the path of said ejected foam, wherein said air deflection barrier comprises said one deflection surface.

12. A convertible spray and foam producing nozzle apparatus as recited in claim 9, wherein said foam forming means includes a second elongate tube member sized to coaxially overly in sliding engagement said first tube member, said second tube member being movable between said first and said second positions and further defining an ejection port; and wherein said foam dispersing means is operatively mounted to said second tube member adjacent said ejection port in a manner such that when said second tube member is disposed in said first position said foam dispersing means enables uninterrupted spray ejection from said spray-forming nozzle, and such that when said second tube member is disposed in said second position said foam dispersing means intercepts and directionally shapes said foam passing through said ejection port, into said fan-shaped pattern.

13. A convertible spray and foam producing nozzle apparatus as recited in claim 12, further including guide alignment means operatively connecting said first and second elongate tube members for maintaining a predetermined fixed radial disposition between said first and said second tube members when said second tube member is disposed in said first position.

14. A convertible spray and foam producing nozzle apparatus as recited in claim 12, including means for rapidly detachably connecting said foam dispersing means to said second elongate tube at its said ejection port.

15. The combination with a wand-type spray nozzle apparatus having an elongate rigid conduit member defining a passageway extending between inlet and outlet ports, a spray-forming nozzle connected at the outlet port for forming and projecting therefrom a spray pattern of fluid passing under pressure therethrough, and handle means connected to the conduit member for enabling an operator to directionally aim the conduit outlet port, of a foam-producing attachment, comprising:

a. an elongate foam producing tube means connected to the conduit member and being movable between first and second positions relative to the conduit member, said foam producing tube means being operable in its said first position to enable the spray-forming nozzle to uninterruptedly project a spray pattern outwardly therefrom and being operable in its said second position to intercept the formed spray pattern, to convert said intercepted spray into foam when the fluid being sprayed contains a surfactant agent and to project the produced foam longitudinally outward from said foam producing tube means;

b. foam dispersing means operatively connected with said elongate foam producing tube means for dispersing the projected foam in a predetermined spread pattern; and c. manually operable attachment means for selectively securing said foam producing tube means to said conduit member between said first and second positions.

* * * * *